United States Patent [19]

Shy

[11] Patent Number: 4,487,342

[45] Date of Patent: Dec. 11, 1984

[54] PUSHBUTTON TYPE BOTTLE CAP

[76] Inventor: Min C. Shy, 20, Alley 18, La. 109, Hoping St., Yang Ho City, Taipei Hsien, Taiwan

[21] Appl. No.: 377,097

[22] Filed: May 11, 1982

[51] Int. Cl.[3] ..... B67D 3/00

[52] U.S. Cl. ..... 222/481.5; 222/484; 222/534; 222/536; 222/545; 222/556

[58] Field of Search ..... 222/478, 481, 482, 484, 222/531, 533, 534, 536, 537, 546, 556, 562, 563, 545, 479, 481.5

[56] References Cited

U.S. PATENT DOCUMENTS

| | | | |
|---|---|---|---|
| 2,639,839 | 5/1953 | Sokolik | 222/479 |
| 3,059,816 | 10/1962 | Goldstein | 222/545 X |
| 3,220,618 | 11/1965 | Lodding et al. | 222/545 X |
| 3,384,276 | 5/1968 | Henningfield | 222/479 |
| 3,516,581 | 6/1970 | Micallef | 222/534 X |
| 3,542,256 | 11/1970 | Waterman | 222/484 |
| 3,655,102 | 4/1972 | Moran | 222/484 |

*Primary Examiner*—Joseph J. Rolla
*Assistant Examiner*—Kevin P. Shaver
*Attorney, Agent, or Firm*—Karl W. Flocks; Sheridan Neimark; A. Fred Starobin

[57] ABSTRACT

A bottle cap of the pushbutton type having a jacket threaded to fit to the bottle top, and a round pushboard interfitted and pivotally mounted in the jacket with protrusions on the pushboard to control openings of an effluent pipe and an air intake pipe mounted in a check board portion of the jacket, with an effluent port and an air intake path in the pushboard for fluid connection to those respective pipes. The ports on the bottom of the jacket leading to the pipes therein are spaced from each other by use of a shield over the bottom port of the air intake pipe allowing pouring of a liquid from the bottle, using a pushbutton type cap, through the effluent pipe, without interference with the air intake system.

3 Claims, 5 Drawing Figures

PUSHBUTTON TYPE BOTTLE CAP

BACKGROUND OF THE INVENTION

In order to discharge the fluid content of a bottle sealed up with a conventional bottle cap, it is usually necessary to first remove the cap. Besides, it is often difficult to control the discharge rate of the fluids by pouring straight from the open bottle mouth. Bottle caps have been provided with inner threads provided on the bottom, and a little hole left on top so as to refrain from removing the cap. Still, when it is intended to discharge the fluid contents, it is necessary to loosen the cap made in this manner before letting out the fluids from the little hole provided on top. The biggest drawback with such caps is that in order to hold onto the bottle body, particularly with those bottles made of plastics or materials other than ceramic glasswares, as a first step to discharge the fluid contents, a pressure, big or small, will be reflected to the bottle mouth. With the cap loosened, the inner threads on the bottom of the cap will easily get detached from the bottle mouth as a result of the pressure induced thereto and eventually result in an unwanted liberal release of the fluid contents.

SUMMARY OF THE INVENTION

Hence the present invention is presented in view of the shortcomings inherent with existent bottle caps as characterized above in order to provide for an improved pushbutton type bottle cap which can be applied to all kinds of bottles of soft or rigid construction to accomplish in an orderly manner the discharging of the fluid contents as contained in the bottle without having to do anything to the bottle body in an endeavor to discharge the fluids.

The present invention provides for a pushbutton type bottle cap in an improved execution comprising a bottle jacket with ports provided on both ends thereof and a check board provided in the center together with a round pushboard that can be engaged movably to the compartment on top of the bottle jacket. An effluent passage and an air intake path are provided at the front end of the pushboard and two protruding plugs are mounted in the top thereof so as to serve to block the effluent pipe and the port to the air intake path extending outside the top of the check board when the cap is securely sealed up and the pushboard is submerged in the interior of the compartment. Thereupon the fluids as contained in the bottle will not have any chance to flow out. When it is desired to discharge the fluid contents of the bottle, pressure is applied against the terminal end of the pushboard to cause the front end thereof to pitch up to the effect that as a result the effluent pipe together with the air intake path at the front end of the pushboard will both become exposed to the outside of the bottle jacket. In the meantime, the protruding plug will also be removed from its plug-in position with respect to the effluent pipe and the port to the air intake path. The bottle is used to spray its contents from the front end of the pushboard at which time the fluid contents will find their way out by way of the effluent pipe and the exit port. In the meantime, ambient air will enter the cap compartment by way of the air intake path and bring in air to create a pressure on the surface of the fluid contents so as to have a smooth and restrained outflow of the fluid from the bottle.

DETAILED DESCRIPTION OF THE PREFERRED EMBODIMENT

Figure 5:
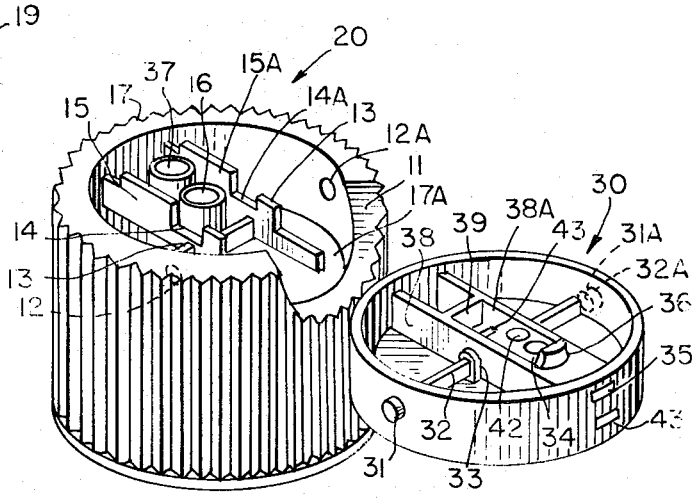
FIG. 5 is a perspective view of the present invention with the upper part rotated bottom up.

Referring to FIG. 1 through FIG. 5, there is shown a bottle cap as covered by the present invention having a jacket 20 in conjunction with a round pushboard 30 that is inserted in the chamber provided in the top of jacket 20 in a movable manner. Inner threads 19 provided in the lower portion of jacket 20 couple with corresponding outer threads 3 provided on top of bottle 2. Circular protrusions 31, 31A are provided extending from opposite sides of pushboard 30 to facilitate engagement into round notches or holes 12, 12A, respectively, provided on opposite sides of the interior of the upper end of jacket 20 to movably connect pushboard 30 to jacket 20. Effluent duct or port 35 and an opening to air intake path 43 are provided at the front side of pushboard 30. Also provided are two protruding plugs 34, 42 to block access respectively to effluent pipe 37 and the port to the air intake pipe 16 extending from the top of check board 17A. The other end of effluent pipe 37 and air intake pipe 16 open respectively on the bottom of the check board 17A and are shielded so that the fluid contents do not block the port of air intake pipe 16 as the bottle is splayed in order to discharge its contents. The outer surface periphery of jacket 20 is provided with sawtooth stripes or knurling 17 to facilitate handling of the bottle and cap. When the cap is tightly fastened, the bushing or depending flange 18 on the underside of jacket 20 will thrust tightly against bottle mouth 1 so that the bottled fluids will be discharged solely via effluent pipe 37. Reference to FIG. 5 shows that on check board 17A in jacket 20 there are provided two twin parallel trestles 15, 15A with U-shape flutes 14, 14A provided at symmetrical positions thereof. On the underside there is provided a support bar 13 across both trestles 15, 15A as a reinforcement structure. The interior of pushboard 30, likewise, is provided with two twin parallel trestles 38, 38A reinforced with a support bar 39 in between, and provided with semi-circular linings 33, 33A on external joints, in linkage with ribs 32, 32A for extension to two circular protrusions 31, 31A protruding externally. As pushboard 30 is placed in and connected to the chamber on top of jacket 20, the circular protrusions 31, 31A at symmetrical positions on the outer rim of pushboard 30 will be engaged into both round notches or holes 12 provided on either side on the interior of the jacket to act as corresponding joints or pivot points. Placement of pushboard 30 on top of jacket 20 forms a chamber 50 enclosed by the checkboard 17A and pushboard 30. Parallel trestles 15, 15A will securely hold to the parallel trestles 38, 38A provided in pushboard 30. Semi-circular linings 33, 33A sit on the U-shape flutes provided substantially in the middle of parallel trestles 15, 15A and rest there. Protruding plugs 34, 42 each serve to block access to effluent pipe 37 and to the port of the air intake pipe 16. Tapered face 41 on the rear side of pushboard 30 rests in U notch 11 as provided on the periphery of jacket 20.

The procedure to open the cap to discharge the fluid bottled therein is as follows. Press fingertips onto tapered face 41 on the rear side of the upper surface of pushboard 30. The result is that effluent duct 35 and the air intake port of air intake path 43 will rise up and be exposed externally as demonstrated in FIG. 4. At the same time protruding plugs 34, 42 will also leave the closed (down) positions with respect to the port to effluent pipe 37 and the port to the air intake pipe 16 thus opening both ports into a conducting state in order to discharge the fluid contents still in the bottle through effluent pipe 37. The bottle is slanted with respect to the front end of pushboard 30 to cause the fluid contents to flow out via bottle mouth 1, effluent pipe 37, and effluent port 35. In addition, a check-flow piece 36 shaped as a sector is provided beneath effluent port 35 to guide the fluids leaving effluent pipe 37 to converge the fluids toward effluent port 35. While all of the abovementioned discharging of fluid is taking place, ambient air will concurrently move into the cap chamber 50 by way of air intake path 43 and eventually enter the bottle via air intake pipe 16 so as to bring air pressure to bear on the fluid surface so as to help produce a smooth discharge of fluid via effluent pipe 37 and port 35. In the closed position of the pushbutton type bottle cap, both ports of the effluent duct 35 are blocked whereas only the intake port of the intake path 43 is blocked and the other port of intake path 43 is open to the enclosed chamber 50.

Figure 1:
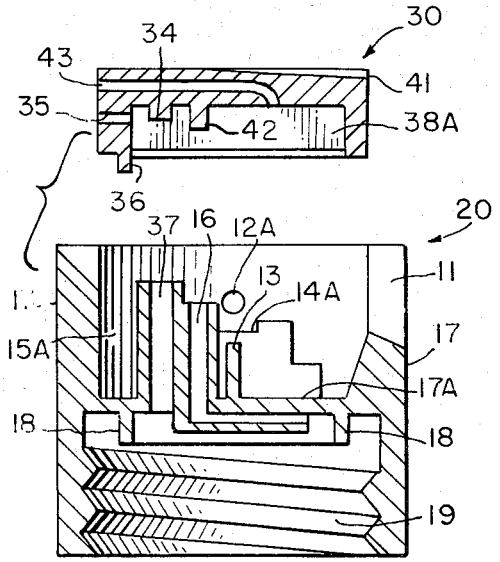
FIG. 1 is a sectional view of the bottle cap as covered in the present invention.
Figure 3:
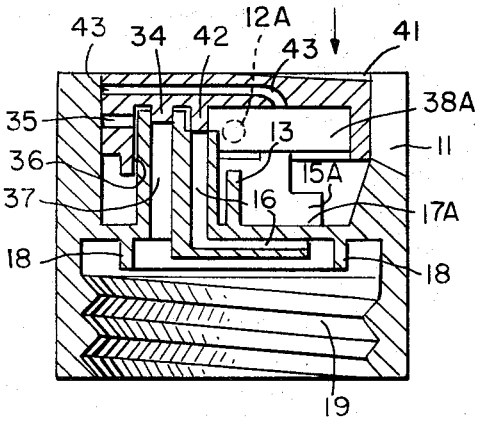
FIG. 3 is a sectional view as in FIG. 1 with the improved pushbutton type bottle cap in a closed state.
Figure 4:
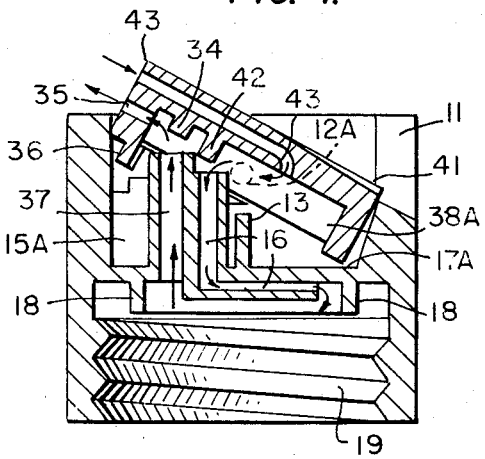
FIG. 4 is a sectioned view as in FIG. 3 but with the improved pushbutton type bottle cap pressed inward to the open position.
Figure 2:
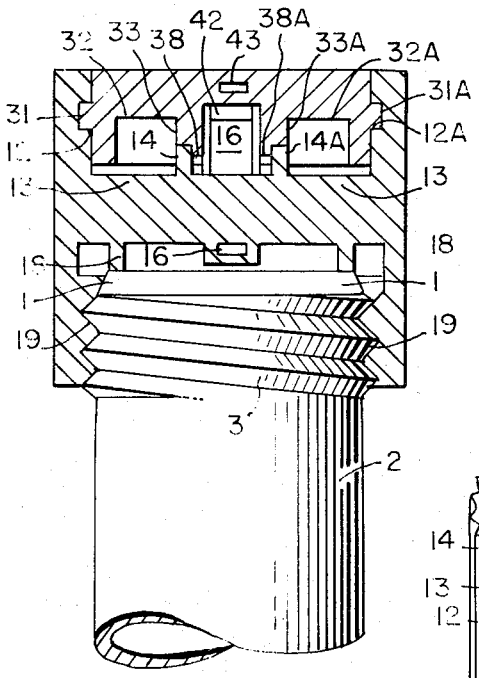
FIG. 2 is a righthand sectioned view revolved 90° from FIG. 1 showing the bottle cap of the present invention as it is united to the mount of a bottle.

The present invention of an improved pushbutton type bottle cap is characterized in its achievement to release fluids as contained in any given bottle provided with the cap of the present invention by way of the effluent port provided therefor, in a smooth manner in conjunction with an air intake port provided on the pushboard that works in coordination with a downstream effluent pipe and air intake pipe provided in the jacket. The present invention comprises means of introducing ambient air into the bottle to produce a driving pressure as the cap is manipulated for a discharging operation. It is a further characteristic that when it is desired to close pushboard 30 thereof, pushboard 30 will be reset back to the position as illustrated in FIG. 3 in an easy manner by exerting a slight pressure against the top surface of the front end of pushboard 30 itself. In the meantime, protruding plugs 34, 42 will each react to block the ports to effluent pipe 37 and air intake pipe 16 thus serving to prevent entry of dust and tiny insects into the bottle. This will also serve to prevent evaporation of the fluid contents of the bottle and unwanted discharging of the fluid in cases where the bottle is turned over.

It will be obvious to those skilled in the art that various changes may be made without departing from the scope of the invention and the invention is not to be considered limited to what is shown in the drawings and described in the specification.

I claim:

1. A bottle cap of the pushbutton type for attachment to the mouth of a bottle comprising a jacket having means for attachment to the mouth of a bottle, a round pushboard pivotally mounted to and interfitted in said jacket for operation by applying pressure to a rear portion of said pushboard to pivot it from a level closed position to a sloping open position relative to said jacket, a checkboard in said jacket mounted below said pivotally mounted pushboard, a chamber enclosed by said pushboard and said checkboard, said checkboard including an effluent pipe having upper and lower ports, an air intake pipe having upper and lower ports, said lower ports of said effluent pipe and said air intake pipe having means to space them from each other to prevent the entrance of fluid contents of the bottle into said air intake pipe, said pushboard including a pair of protruding plugs on the bottom of said pushboard in positions to block the upper ports of said effluent pipe and said air intake pipe when said pushboard is in a level closed position, an effluent duct and an air intake passage in said pushbutton each having ports opening forward at one end of each said duct and said passage, and having ports at their opposite ends fluidly connected respectively with said upper ports of said effluent pipe and said air intake pipe, said port on the opposite end of said air intake passage opening into said chamber, said effluent duct and said air intake passage having their forward openings exposed when said pushboard is in a sloping open position and covered when said pushboard in in a level closed position, said air intake passage fluidly connected to said air intake pipe through said chamber when said pushboard is in a sloping open position, and said air intake passage open only to said chamber when said pushboard is in a level closed position, whereby a pushbutton type bottle cap delivers a smooth outflow of fluid in its open position and is doubly secured against spillage or evaporation in its closed position.

2. The bottle cap of claim 1, further characterized by said spacing means located on said lower port of said air intake pipe and being a shield protecting said air intake pipe at its lower opening so that said port is spaced away from said lower port of said effluent pipe by said shield.

3. The bottle cap of claim 1, further characterized by a check-flow means shaped like a sector and located beneath said port of said effluent duct on an underneath portion of said pushboard to guide fluid from said effluent pipe to said effluent duct.

* * * * *